US005489930A

United States Patent [19]

Anderson

[11] Patent Number: 5,489,930

[45] Date of Patent: Feb. 6, 1996

[54] INK JET HEAD WITH INTERNAL FILTER

[75] Inventor: Jeffrey J. Anderson, Camas, Wash.

[73] Assignee: Tektronix, Inc., Wilsonville, Oreg.

[21] Appl. No.: 56,101

[22] Filed: Apr. 30, 1993

[51] Int. Cl.[6] ..... B41J 2/19

[52] U.S. Cl. ..... 347/71; 29/163.8; 210/488; 347/93

[58] Field of Search ..... 346/1.1, 75, 140 R; 210/488, 498; 222/189; 205/75; 29/163.6, 163.8; 347/70, 71, 93, 20

[56] References Cited

U.S. PATENT DOCUMENTS

| | | | |
|---|---|---|---|
| 4,046,359 | 9/1977 | Gellert | 210/488 X |
| 4,639,748 | 1/1987 | Drake et al. | 346/140 R |
| 4,680,595 | 7/1987 | Cruz-Uribe et al. | 346/140 R |
| 4,864,329 | 9/1989 | Kneezel et al. | 346/140 R |
| 4,883,219 | 11/1989 | Anderson et al. | 228/190 |
| 5,087,930 | 2/1992 | Roy et al. | 346/140 R |

FOREIGN PATENT DOCUMENTS

| | | | |
|---|---|---|---|
| 2713290 | 3/1977 | Germany . | |
| 54-53832 | 4/1979 | Japan . | |
| 61-189943 | 8/1986 | Japan | 347/93 |

OTHER PUBLICATIONS

Excerpt from Apr. 16, 1992 confidential Tektronix internal report "Jolt Fru Investigation" by Don MacLane (4 pages).

*Primary Examiner*—Benjamin R. Fuller
*Assistant Examiner*—Alrick Bobb
*Attorney, Agent, or Firm*—Ralph D'Alessandro

[57] ABSTRACT

An internal ink filter (12) located within an ink jet print head (10) is formed by overlapping filter portions (100 and 102) of two laminated plates (22 and 24) that comprise the print head. Each plate includes an array of holes (120) in the filter portion. The individual holes have an opening dimension (122) such that the plates can be easily manufactured using conventional techniques, although the opening dimension may be too large for effective filtering. The plates are juxtaposed with the holes of each plate partly overlapping the holes of the other plate. The areas of overlap define a filter pore smaller than the individual holes in each plate.

15 Claims, 7 Drawing Sheets

INK JET HEAD WITH INTERNAL FILTER

TECHNICAL FIELD

This invention relates to ink jet printers and in particular to an internal fluid filter in an ink jet print head.

BACKGROUND OF THE INVENTION

Ink jet systems, and in particular multiorifice, drop-on-demand ink jet systems, are well known in the art. A multi-orifice, drop-on-demand ink jet print head receives ink from an ink supply and ejects drops of ink through multiple orifices onto a print medium. Both thermal-type ink jet heads, which eject a drop by heating the ink to form a bubble, and impulse-type ink jet heads, which eject a drop by compressing a chamber, are common.

A thermal-type drop-on-demand ink jet print head is typically constructed by bonding together silicon wafers or hybrid thin film circuit substrates, the wafers or substrates having appropriate circuitry and chambers formed on their surfaces. An impulse-type drop-on-demand ink jet print head is typically constructed by bonding together multiple plates, the various chambers and channels being formed by appropriate holes in individual plates.

A typical impulse-type multiple orifice drop-on-demand ink jet print head has a body that defines plural ink pressure chambers which are generally planar in the sense that they are much larger in cross-section than in depth. The ink pressure chambers each have an ink inlet and an ink outlet. The ink jet print head includes an array of proximately located nozzles and passages for coupling the ink pressure chambers to the nozzles. Each ink pressure chamber is coupled by an associated passage to an associated nozzle. A driver mechanism is used with each pressure chamber to displace the ink in the ink chamber. The driver mechanism typically consists of a transducer (e.g., a piezoelectric ceramic material) bonded to a thin diaphragm. When a voltage is applied to the transducer, the transducer attempts to change its planar dimensions, but, because it is securely and rigidly attached to the diaphragm, bending occurs. This bending displaces ink in the ink-chamber, causing the flow of ink both through an inlet from the ink supply to the ink chamber and through an outlet and passageway to a nozzle.

The inlet of each pressure chamber is connected via a passage to a common ink manifold that supplies ink to several pressure chambers. An orifice is sometimes positioned between the pressure chamber and the ink manifold to reduce acoustic crosstalk between pressure chambers. The use of such a restrictor orifice is described in U.S. Pat. No. 4,680,595 of Cruz-Uribe et al. for an Impulse Ink Jet Print Head and Method for Making Same.

For high resolution printing, it is desirable that the nozzles have very small orifices and be spaced as closely as possible. Close spacing requires correspondingly small internal channels. One method of achieving close spacing is described in U.S. Pat. No. 5,087,930 of Roy et al. for a Drop-on-Demand Ink Jet Print Head, which is assigned to the assignee of the present invention. Such small orifices and internal channels in multiple orifice ink jet print heads are susceptible to clogging from particulate contamination. During assembly, particulate contamination from the assembly room environment, chromate plating flakes from ink reservoirs supplying ink to the head, and contamination from the O-rings and reservoir sealing materials are often inadvertently introduced into the interior of the print head.

U.S. Pat. No. 4,639,748 of Drake et al. for an Ink Jet Printhead With Integral Ink Filter illustrates an attempt to solve the particulate contamination problem. The patent describes a thermal ink jet print head constructed from two silicon wafers bonded together adjacent and having an integral ink filter. The integral filter, positioned between an internal ink reservoir chamber and capillary-filled ink supply channels, is formed by anisotropically and isotropically etching channels smaller than the nozzle orifices into the silicon composing the wall between the reservoir chamber and the supply manifold. Such fabrication methods are usable only for components fabricated from single crystal materials that etch at different rates along different crystal planes, because other materials cannot be anisotropically etched to create the required structures. With current metal-working technology, it is impractical to manufacture a metallic layer with filter pores having a sufficiently small opening to prevent clogging of very small nozzles.

Another ink filter for a thermal ink jet print head is described in U.S. Pat. No. 4,864,329 of Kneezel et al. for a Fluid Handling Device With Filter and Fabrication Process Therefor. The print head described by Kneezel et al. comprises two silicon wafers, one of which is etched to define ink channels, and ink manifolds having a fill hole. A wafer-sized, flat membrane filter is bonded to the silicon wafer surface over the fill holes to filter the ink before it enters the internal channels of the print head. If the print head is constructed in the "roofshooter" configuration, i.e., the nozzles are located on the top surface of a silicon wafer, the membrane filter can be positioned between the two silicon wafers and bonded to both. Such a filter must be very flat to prevent ink from seeping around the filter.

A membrane filter added to the print head increases the thickness, the difficulty of manufacturing, and cost of the print head. A membrane filter layer can also introduce mechanical stress into the head during assembly because the thermal coefficient of expansion of the mesh material may not match that of the material comprising the rest of the head. This is especially a significant problem where phase change inks are used.

Still another attempt to solve the contamination problem in print heads is illustrated in a "JOLT"® Model printer by Dataproducts Corp. of Woodland Hills, Calif. The Jolt model printer places a filter fabricated from a single plate transversely across the manifold at the interface between the reservoir manifold and the print head, which increases manufacturing difficulty and does not protect against initial contamination introduced during the assembly processes.

It is generally recognized that filters are desirable to trap particulate contamination in ink jet print heads before such particulate contamination can clog orifices in the print head. As newer, higher resolution printers require increasingly smaller orifices, it has become more difficult to fabricate using conventional processes a filter having pores sufficiently small to protect such smaller orifices.

SUMMARY OF THE INVENTION

An object of the present invention is, therefore, to improve print quality in a multiple nozzle ink jet print head by providing an internal filter to prevent clogging of passages and orifices within the head by using conventional construction techniques.

Another object of this invention is to provide such a filter for a metallic laminated ink jet print head.

A further object of this invention is to provide such a filter without significantly increasing the cost or thickness of the print head by utilizing existing layers of the print head.

Yet another object of this invention is to provide a filter integral with a print head to prevent clogging of passages and orifices within the print head resulting from contamination introduced into the passages and orifices during manufacturing and assembly of the print head.

The present invention is directed to an internal filter for an ink jet print head and a method of forming the internal filter. A filter is typically formed within an ink supply manifold by the combination of two print head layers that make up a part of the print head. Each layer has a filtering portion formed by punching or etching holes of a size that can be readily etched or punched by conventional processes. Holes provided using conventional technology are, however, too large to be used individually as ink filters in print heads using nozzles having very small orifices.

In accordance with the present invention, the holes in the filtering portions of the two print head layers are patterned so that when the two layers are placed together, the holes of each print head layer are offset from each other and partly overlap. The overlapping portions of the holes create filter pore openings having smaller cross-sectional areas than those of the holes in the print head layers. The resulting filter pore openings allow ink to pass, but prevent particulate contamination in the ink from reaching the nozzle, orifice, or internal passages where such particles could impede the flow of ink while preserving the design thickness of the existing parts.

Forming the filter within the manifold, rather than between the manifold and an external ink supply, enables the filter to trap particulate contamination inadvertently introduced into the print head during assembly. The combined cross-sectional area of all the filter pore openings is sufficiently large to allow the required quantity of ink to flow at the required flow rate through the manifold, into the pressure chambers, and out the nozzles, but small enough to be an effective trap to retain contaminate particles.

Additional objects and advantages of the present invention will be apparent from the following detailed description of a preferred embodiment thereof, which proceeds with reference to the accompanying drawings.

DETAILED DESCRIPTION OF PREFERRED EMBODIMENTS

An internal filter of the present invention will be described as implemented in a drop-on-demand, impulse-type print head described in U.S. patent application Ser. No. 07/894,316 of Crawford and Burr for a Drop-on-Demand Ink Jet Print Head Having Improved Purging Performance, which is assigned to the assignee of the present invention and which is hereby incorporated in its entirety by reference. However, it will be obvious that the invention is not limited to such an implementation.

Figure 1A:
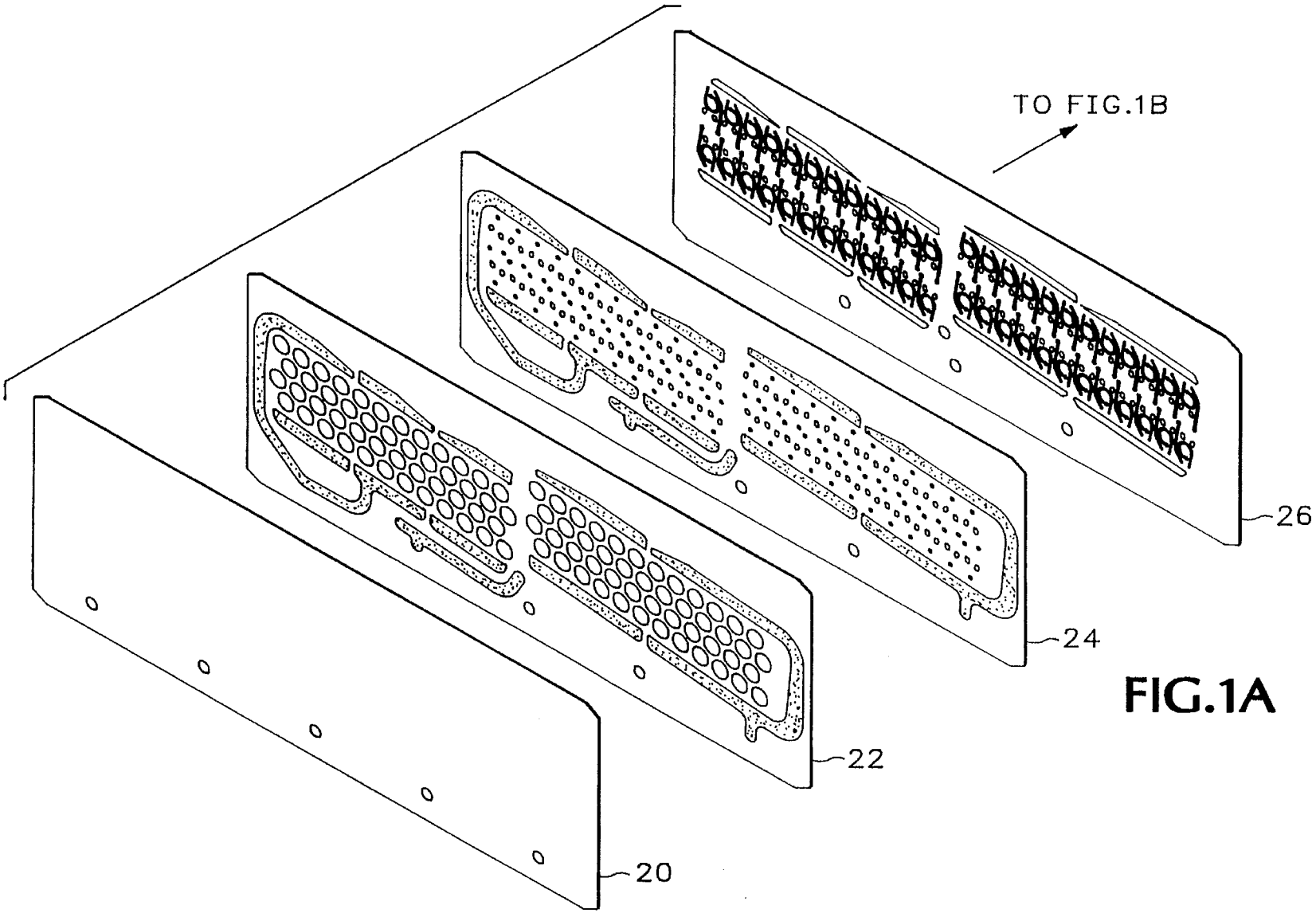
FIGS. 1A and 1B together form an exploded isometric view of the various layers of an ink jet print head having two arrays of 48 nozzles each.
Figure 1B:
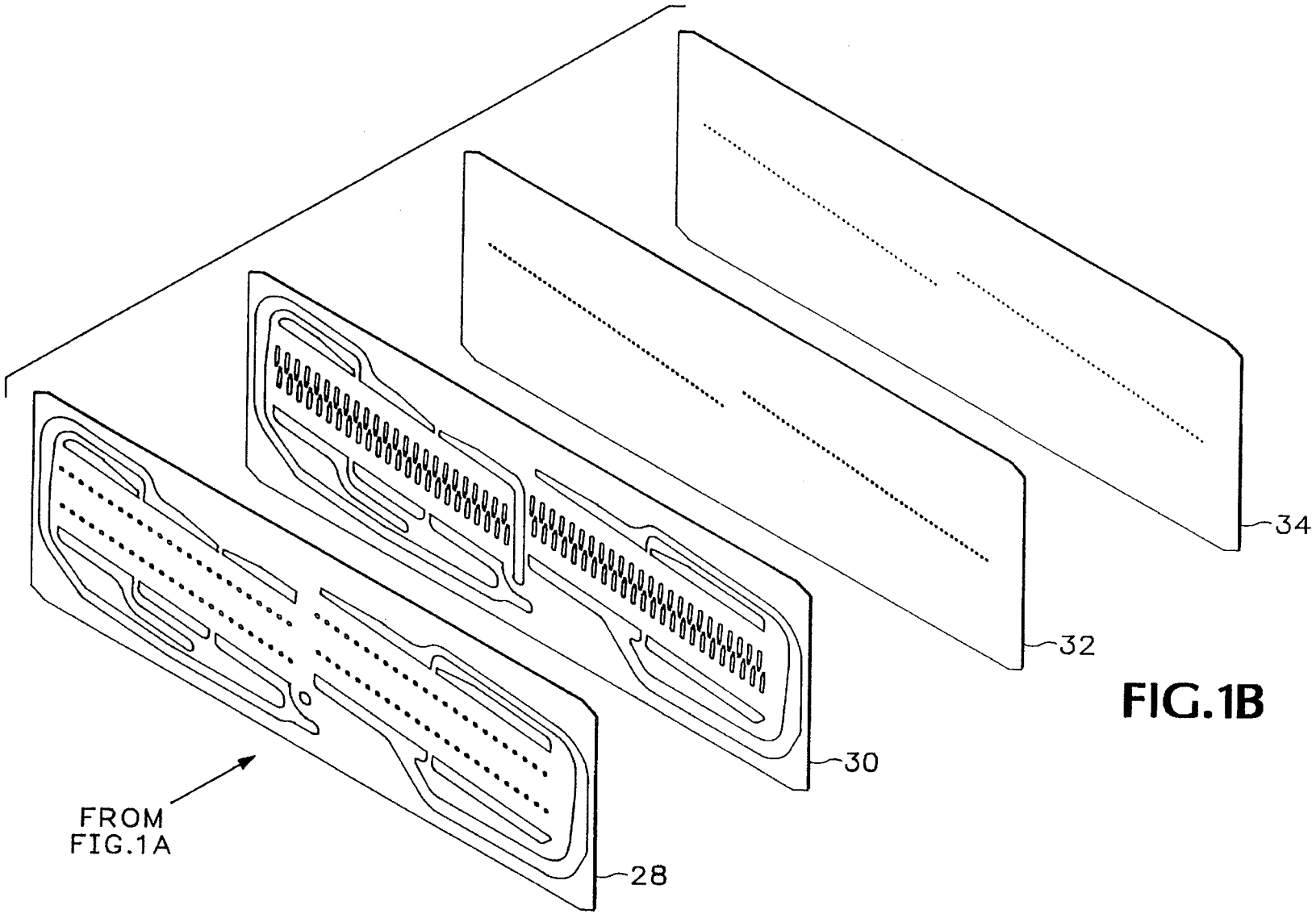

FIGS. 1A and 1B show that a typical ink jet print head 10 having an internal filter 12 of the present invention is constructed by combining various thin plates 20, 22, 24, 26, 28, 30, 32, and 34. Each plate includes holes so that when the plates are superimposed, holes in individual plates define various inlets, outlets, chambers, channels, and internal filter 12 of the present invention. The plates are typically bonded together by diffusion bonding and brazing.

Figure 2:
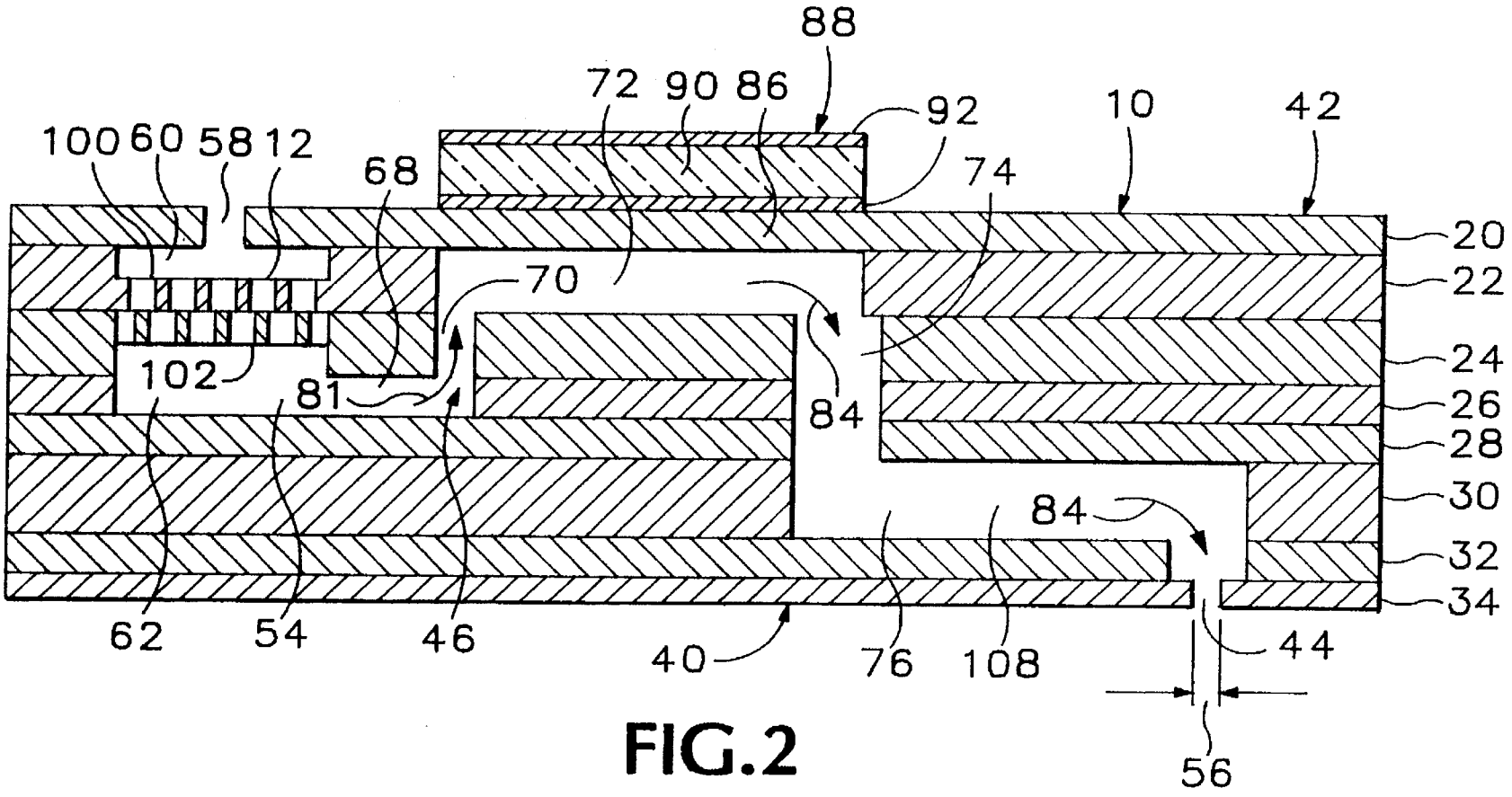
FIG. 2 is a diagrammatic cross-sectional view of a single ink jet of the type used in a multiple orifice ink jet head having an internal filter of the present invention.

FIG. 2 is a diagrammatic cross-sectional view of a typical ink jet 40 of the type included in print head 10. Referring to FIG. 2, a typical jet is shown having a body 42 that defines an ink drop forming orifice outlet or nozzle 44 together with an ink flow path 46 from a tapered ink supply manifold 54 (tapering not shown in FIG. 2) to nozzle 44. In general, a typical ink jet print head 10 includes an array of nozzles 44 that are closely spaced from one another for use in printing drops of ink onto a print medium (not shown). Each nozzle is characterized by a nominal nozzle opening dimension 56. Ink supply manifold 54 serves as the ink supply for multiple nozzles 44 and is supplied with ink from an ink reservoir (not shown) outside of the print head through a single manifold ink inlet 58.

Ink enters an ink inlet 58 from the ink reservoir and flows into tapered ink supply manifold 54. A typical ink jet print head has at least four such manifolds for receiving, black, cyan, magenta, and yellow ink for use in black plus three-color subtraction printing. The number of such manifolds, however, varies depending upon the printer design.

Tapered manifold 54 is divided by internal filter 12 into two parallel, planar portions, a pre-filter portion 60, and a post-filter portion 62. Ink flows from the pre-filter portion 60 of tapered ink supply manifold 54 through internal filter 12 and into the post-filter portion 62. Particulate contamination sufficiently large to clog downstream components is stopped by filter 12. Ink flows from post-filter portion 62 through an ink supply channel 68, through a pressure chamber ink inlet 70, and into an ink pressure chamber 72. Ink leaves pressure chamber 72 by way of an ink pressure chamber outlet 74 and flows through an ink passage 76 to nozzle 44, from which ink drops are ejected. Arrows 84 show the just-described ink flow path.

Ink pressure chamber 72 is bounded on one side by a flexible diaphragm 86. Secured to diaphragm 86 and overlaying ink pressure chamber 72 is a pressure transducer 88 comprising a piezoelectric ceramic disc 90 and metal film layers 92 to which an electronic circuit driver (not shown) is electrically connected. The ceramic disc transducer 88 is typically operated in its bending mode such that when a voltage is applied across metal film layers 92, pressure transducer 88 attempts to change its dimensions. However, because it is securely and rigidly attached to the diaphragm, pressure transducer 88 bends and thereby displaces ink in ink pressure chamber 72, causing the outward flow of ink through passage 76 to nozzle 44. Refill of ink pressure chamber 72 following the ejection of an ink drop can be augmented by reverse bending of pressure transducer 88.

To facilitate manufacturing, the body 42 of ink jet print head 10 having internal filter 12 of the present invention is preferably formed of multiple laminated layers, each layer comprising a plate or sheet of a material, such as stainless steel, that is rigid and does not react with ink. FIG. 2 shows sheets 20, 22, 24, 26, 28, 30, 32, and 34 stacked in a superimposed relationship. As illustrated in FIGS. 1A, 1B, and 2, these sheets or plates include diaphragm plate 20, which forms diaphragm 86 and ink inlet 58; ink pressure chamber plate 22, which forms a first or upper portion 100 of filter 12 and defines ink pressure chamber 72 and a portion of ink supply manifold 54; separator plate 24, which forms a second or lower portion 102 of internal filter 12, bounds one side of ink pressure chamber 72 and defines inlet 70, and outlet 74 of ink pressure chamber 72 and portions of ink supply manifold 54 and ink passage 76; ink inlet plate 26, which defines inlet channel 68 and a portion of passage 76; separator plate 28, which defines portions of passage 76; offset channel plate 30, which defines a major offset portion 108 of passage 76; separator plate 32, which defines a portion of passage 76; and nozzle plate 34, which defines nozzles 44 of the array.

More or fewer plates than those illustrated may be used to define the various ink flow passageways, manifolds, and pressure chambers of ink jet print head 10 of the present invention. For example, multiple plates may be used to define ink pressure chamber 72 instead of the single plate illustrated in FIG. 1. Also, not all the various features need be in separate sheets or layers of metal. For example, ink passages could be defined by grooves in a plate, rather than holes, and different patterns could be etched on opposite sides of the plates. Furthermore, by using an additional plate, upper and lower portions 100 and 102 of filter 12 can be made from the entire thickness of respective plates 22 and 24, or two plates 24 which have different filter patterns instead of from partial thicknesses as shown in FIG. 2. Alternatively, different filter-patterned plate 24 could be used in place of plate 22.

To minimize fabrication costs, all the metal layers of ink jet print head 10, except nozzle plate 34, are designed so that they may be fabricated using relatively inexpensive conventional photo-patterning and etching processes in metal sheet stock.

Figure 3:
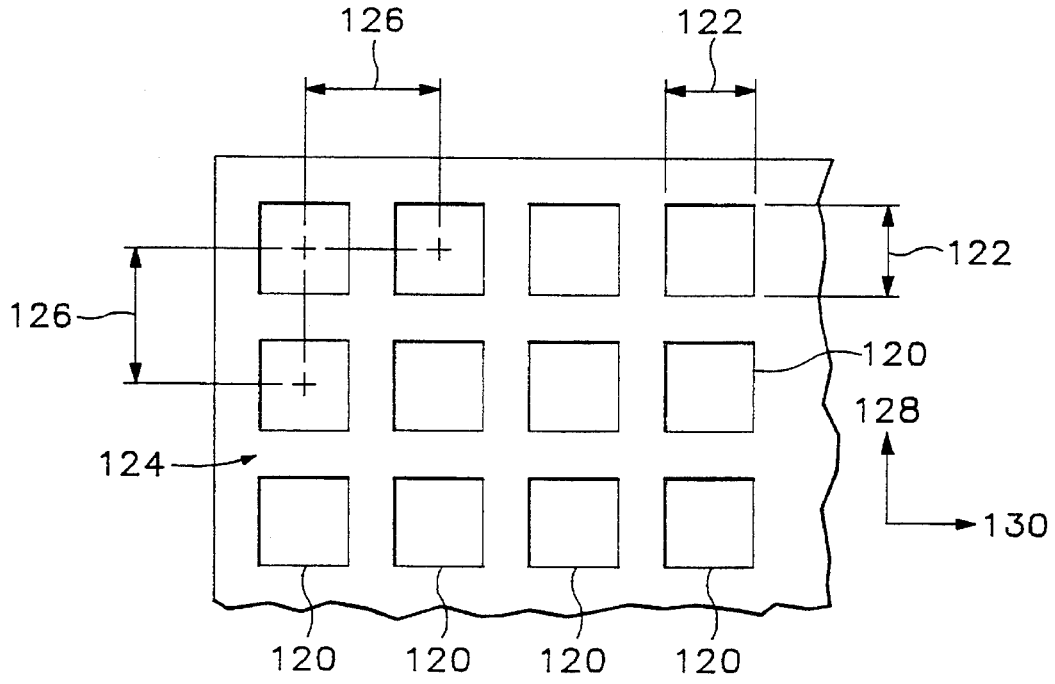
FIG. 3 is an enlarged, diagrammatic plan view of part of the filtering portion of a print head layer of the current invention.

FIG. 3 shows part of the preferred embodiment of upper filter portion 100 of layer 22. (Lower filter portion 102 is similar.) Multiple holes 120, each having a rectilinear or square shape, with each edge of the squares having an opening dimension or length 122, are formed in upper filter portion 100 by conventional etching or stamping. Length 122 has a preferred range of between about 0.004 and about 0.012 inches, with approximately 0.008 inches most preferred. Holes 120 are formed in a rectilinear array 124, with centers of adjacent holes 120 displaced from each other by a distance 126, in each of the two mutually perpendicular directions indicated by axes 128 and 130 of array 124. Lower filter portion 102 of layer 24 is formed in a manner similar to that of upper filter portion 100.

Figure 4:
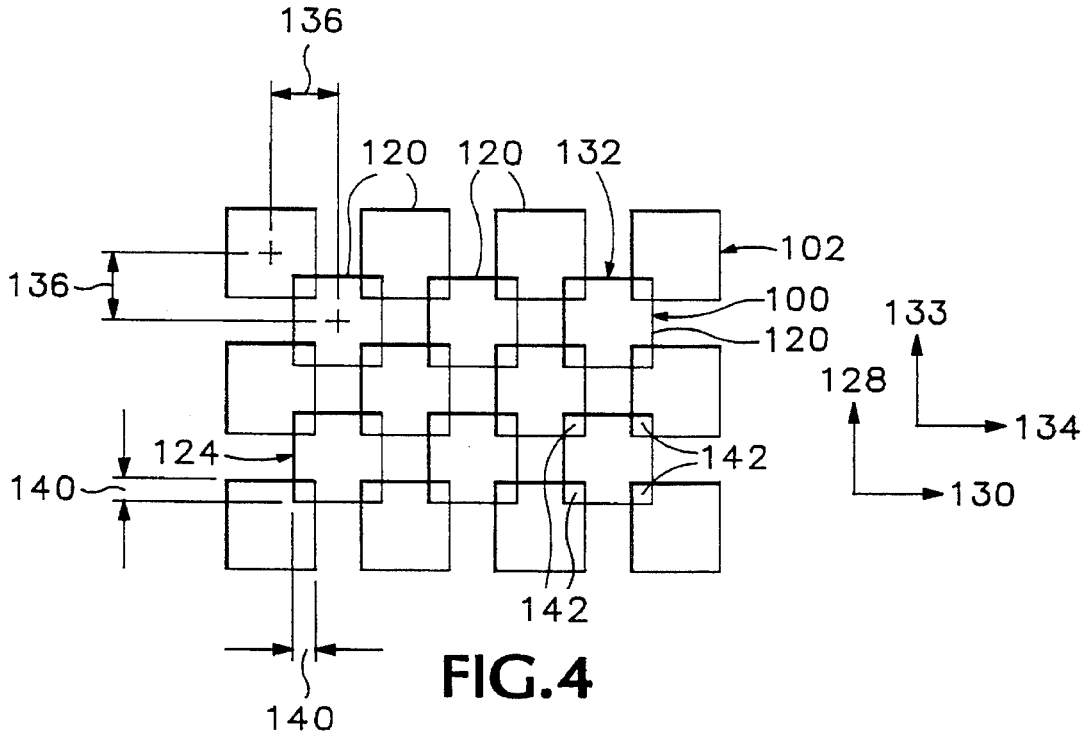
FIG. 4 is an enlarged diagrammatic plan view of the filtering portions of two print head layers of the present invention juxtaposed to one another.
Figure 5:
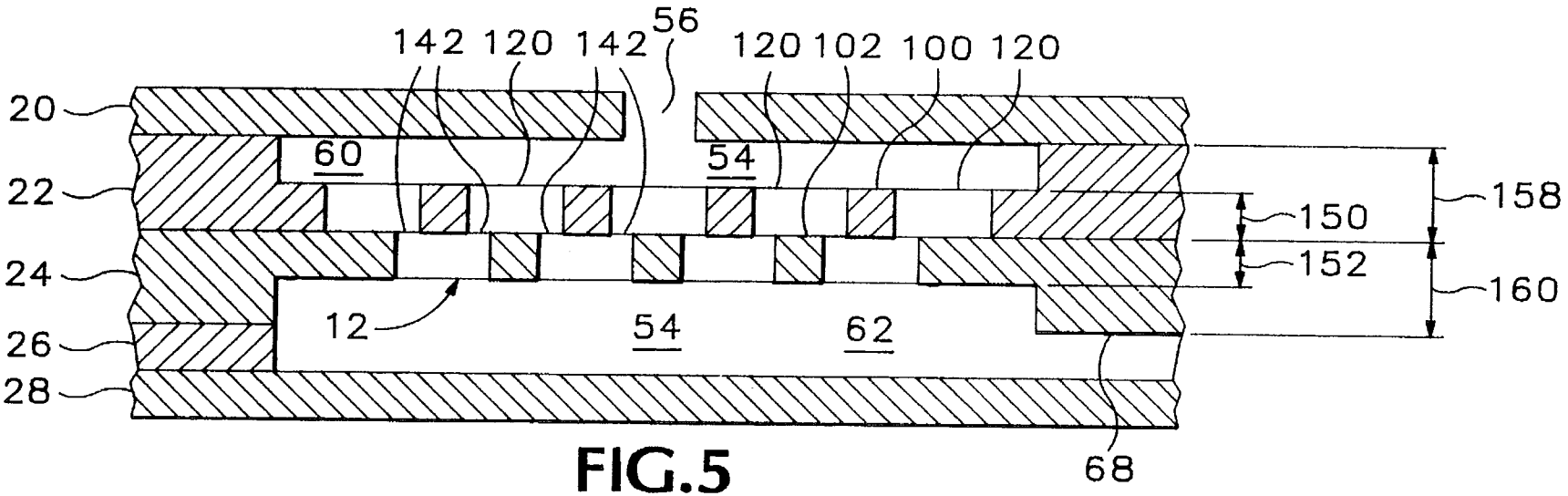
FIG. 5 is an enlarged detailed view showing the internal filter of FIG. 2.

FIG. 4 shows a plan view of upper filter portion 100 placed over lower filter portion 102. FIG. 5 is an enlarged detailed view of a cross-section of filter 12 from FIG. 2. An array 132 of holes 120 of the upper filter portion 100 have axes 133 and 134 which are rotationally aligned with axes 128 and 130 of array 124 of holes 120 of lower portion 102, but the holes 120 of lower filter portion 102 are displaced relative to those of upper portion 100 by a distance 136 in along axes 128 and 130. In other words, array 132 is displaced but not rotated relative to array 124. The displacement distance 136 determines the area of overlap of holes 120 in the upper and lower filter portions 100 and 102 and, therefore, determines a width 140 of a filter pore opening 142 in the internal filter. Width 140 defines a nominal filter pore size for filter 12.

Filter pore opening 142 should be sufficiently small to prevent the passage of particles that could clog the print head, yet sufficiently large so that the combined pore area of all filter pore openings 142 of filter 12 permits a sufficient flow of ink. The ratio of the nominal filter pore size to nozzle opening diameter 56 is less than about 3.0 and preferably between about 0.3 and about 1.0.

The displacement distance 136 has a preferred value of the distance 126 divided by 2. In a most preferred embodiment, displacement distance 136 is approximately equal to 0.006 inches (0.152 mm), resulting in filter pore openings 142 having a square shape, each side of the square having width 140 equal to 0.002 inches (0.051 mm). The total filter pore area, i.e., the combined area of all filter pore openings 142, is sufficient to allow adequate ink to flow to all nozzles 44 receiving ink from manifold 54. The ratio of the total filter pore area in manifold 54 to the total nozzle opening area, i.e., the combined nozzle opening areas of all nozzles supplied from manifold 44, is greater than about 1 and preferably between about 100 and about 1,000.

Filter 12 comprises filter pore openings 142 smaller than holes 120 in the two filter portions that form filter 12. The holes of the first array of holes have an opening dimension of between about 0.004 to about 0.0012 inches. Obviously, the shape of holes 120, the configuration of holes 120 within arrays 124 and 132, and the relative displacement between holes 120 of arrays 124 and 132 can be varied without departing from the underlying principles of the invention.

FIG. 5 shows that filter portions 100 and 102 have respective thicknesses 150 and 152, and plates 22 and 24 have respective thicknesses 158 and 160. Thicknesses 150 and 152 are preferably less than respective thicknesses 158 and 160, thereby increasing the capacity of manifold 54 without increasing the overall thickness of print head 10. Thicknesses 150 and 152 can be made less than respective thicknesses 158 and 160 by conventional etching processes.

Figure 6:
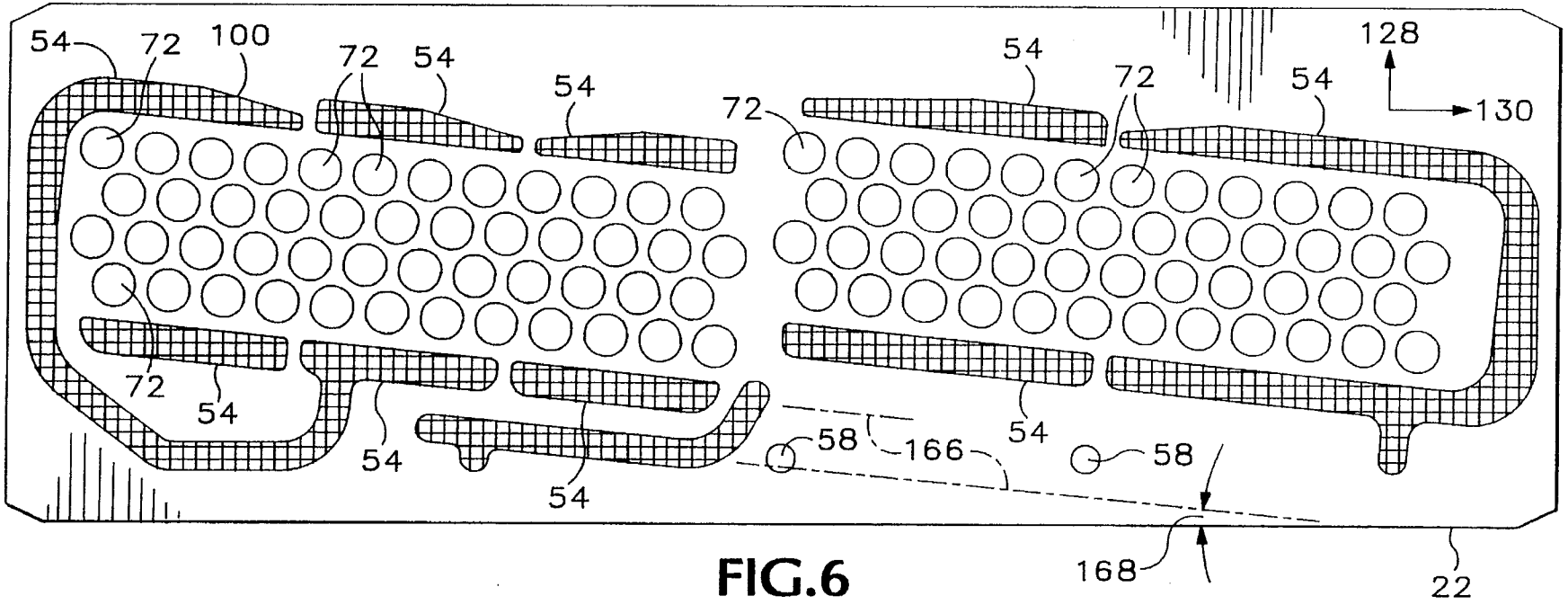
FIGS. 6 and 7 are enlarged frontal views of the respective pressure chamber plate and separator plate of FIG. 1A.
Figure 7:
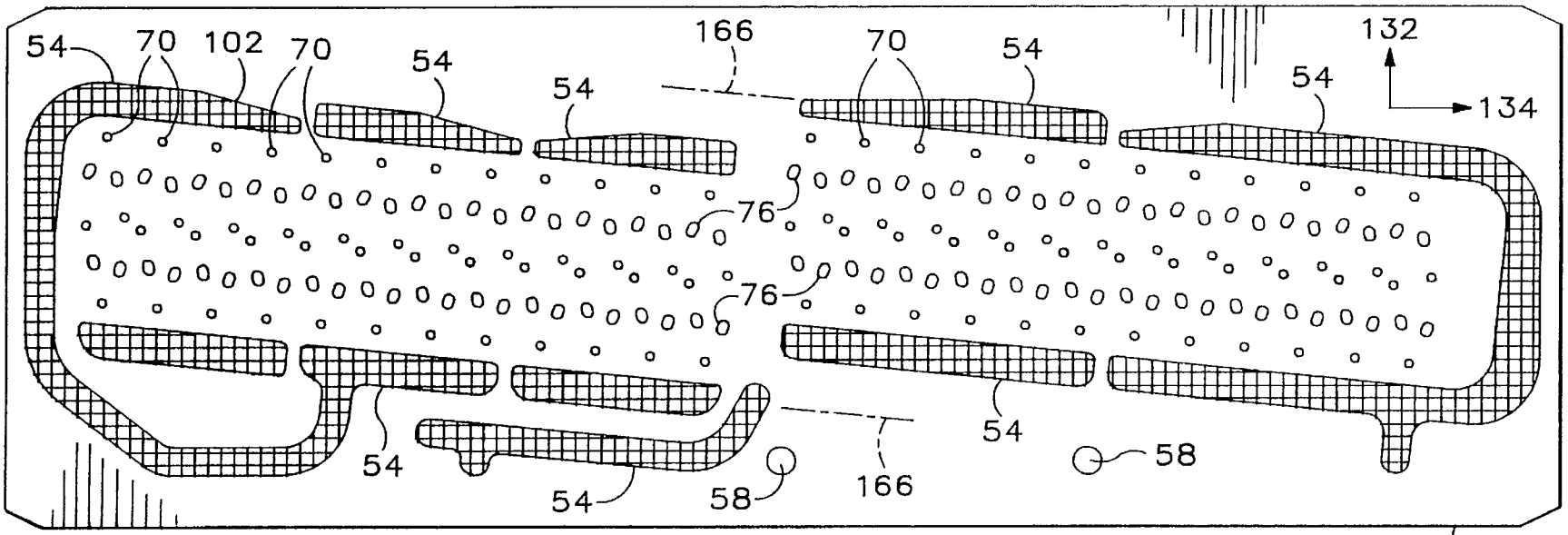

FIGS. 6 and 7 illustrate, respectively, ink pressure chamber plate 22 and separator plate 24. Each of plates 22 and 24 include areas of square holes 120 defining upper filter portions 100 and lower filter portions 102. Longitudinal axes 166 of manifolds 54 are oriented at an angle 168, preferably about 5.71 degrees with respect to the edges of plate 22 and 24. Axes 128, 130, 133, and 134 of respective hole arrays 124 and 132 are substantially rotationally aligned with the edges of plates 24 and 26 and, therefore, intersect longitudinal axes 166 of manifolds 54 at angle 168. When plates 24 and 26 are aligned and bonded together, holes 120 in plate 24 will be offset by a distance 126 in along axes 128 and 130, thereby creating a filter having a nominal filter size defined by width 140 as described above.

The manifolds 54 and communication channels of layer 22 are aligned with similar manifolds and communication channels of layer 24. For added volume and acoustic compliance, portions of the respective manifolds are defined by layer 26.

Therefore, in the above-described manner, post-filter portion 62 of manifold 54 is supplied with ink that is filtered as it passes through manifold 54. In the print head construction described, the volume of each manifold is increased by including portions of the manifold sections in multiple plates and by using less than the complete plate thicknesses to form upper and lower filter portions 100 and 102.

Print head 10 is designed so that layer-to-layer alignment is easily achievable so that tolerances typically held in a chemical etching process are adequate. The various layers forming ink jet print head 10 may be aligned and bonded in any suitable manner, including the use of suitable mechanical fasteners. However, a preferred approach for bonding the metal layers is described in U.S. Pat. No. 4,883,219 of Anderson et al. for Manufacture of Ink Jet Print Heads by Diffusion Bonding and Brazing, which is assigned to the assignee of the present application and is hereby incorporated by reference in its entirety. This bonding process is hermetic, produces high strength bonds between the parts, does not plug the small channels in the print head, does not distort the features of the print head, and yields an extremely high percentage (almost 100 percent) of satisfactory print heads. This manufacturing process can be implemented with standard plating equipment, standard hydrogen furnaces, and simple diffusion bonding fixtures, and can take fewer than three hours from start to finish for the complete bonding cycle, during which many ink jet print heads are simultaneously manufactured. In addition, the plated metal is so thin that essentially all of it diffuses into the stainless steel during the brazing step or is used to fill asperities between the layers. Because plates 22 and 24 are constructed from the same materials as the other plates comprising print head 10, there is no thermal coefficient of expansion mismatch introduced by the presence of filter 12 and, consequently, no distortion introduced during the bonding process.

In operation, ink is supplied from a reservoir (not shown) through manifold inlet 58 to pre-filtered portion 60 of tapered reservoir 54, through filter 12 and into the post-filtered portion 62 of tapered reservoir 54. A plurality of drive signal sources drive multiple associated transducers 88 causing ink to be drawn through inlet channels 68 and 70, into ink pressure chamber 72, and then out through ink passage 76 and nozzle 44. The flow rate of the ink depends on the electrical drive waveform with which the drive signal source separately drives each of pressure transducers 88. Each pressure transducer 88 is provided with substantially identical drive waveforms to effect equal jetting characteristics for each separate nozzle. The equal jetting characteristics stem from the acoustically equivalent design of similar features of the separate orifice channels as described in U.S. Pat. No. 5,087,930 previously cited.

Ink pressure chamber plate 22 of FIG. 1A shows preferred inlet manifolds 54 situated outside the boundaries of the four rows of pressure chambers 72. In addition, the cross-sectional dimensions of ink inlet manifolds 54 are sized and tapered to contain the smallest volume of ink and yet supply sufficient ink to the jets 40 when all ink jets 40 are simultaneously operating and to provide sufficient compliance to minimize jet-to-jet crosstalk. The ink flow rate at any point in manifold 54 depends on the number of orifice inlet channels 68 drawing ink downstream of that point in manifold 54. Tapering inlet manifold 54 by decreasing its cross-sectional areas as a function of the number of inlet channels 68 downstream of various points in the manifolds regulates the ink flow rate.

Although multiple inlet channels 68 are supplied with ink from each manifold 54, acoustic isolation among the ink chambers coupled to common manifold 54 is achieved because with the above-described construction, ink supply manifolds 54 and inlet channels 68 function as acoustic resistance-capacitance circuits that dampen pressure pulses. These pressure pulses otherwise could travel back through the inlet channel from the pressure chamber in which they were originated, pass into common manifold 54, and then into adjacent orifice inlet channels 104 to adversely affect the performance of adjacent jets.

It will be obvious to those having skill in the art that many changes may be made to the details of the above-described embodiment of this invention without departing from the underlying principles thereof. Accordingly, it will be appreciated that this invention is also applicable to applications other than those found in drop-on-demand ink jet recording and printing. The scope of the present invention should, therefore, be determined only by the following claims.

I claim:

1. A laminated ink jet print head having a plurality of plates assembled together, comprising:

a nozzle for ejecting ink onto a print medium;

an ink source for supplying ink to the nozzle;

an ink flow path from the ink source to the nozzle;

a plurality of superimposed and bonded together layers of plates of material thereby forming the laminated ink jet print head, the laminated ink jet print head including an ink supply manifold, inlets, outlets, and flow channels defined by openings in the plates all in the ink flow path to retain ink within the laminated ink jet print head; and a filter positioned in the ink flow path within the ink supply manifold formed from two layers of plates of material from the plurality of layers of plates of material forming the laminated ink jet print head, the two layers having a first filter portion and a second filter portion, each having multiple holes of rectilinear cross-section formed in a rectilinear array and being juxtaposed to each other with the holes of each filter portion having centers such that the centers of adjacent holes are displaced from each other by a fixed distance in each of two perpendicular directions so that the centers of the adjacent holes in the first filter portion are separated by a displacement distance from the centers of the adjacent holes in the second filter portion and the adjacent holes of the first filter portion partly overlap the adjacent holes of the second filter portion to create an area of overlap of holes, the displacement distance determining the area of overlap of holes, the overlapping holes further defining plural filter pores smaller than the holes in the first filter portion and the second filter portion.

2. The ink jet print head of claim 1 in which each of the first filter portion and the second filter portion separately have a thickness different from either of the two layers of material.

3. The ink jet print head of claim 1 in which the first filter portion and the second filter portion comprise stainless steel.

4. The ink jet print head of claim 1 wherein the nozzle has a nominal nozzle opening dimension and in which the filter has a nominal pore size, and a ratio of the nominal pore size to the nominal nozzle opening dimension is such as to substantially prevent clogging of the nozzle.

5. The ink jet print head of claim 4 in which the ratio of the nominal pore size to the nominal nozzle opening dimension is from about 0.3 to about 1.0.

6. The ink jet print head of claim 1 further comprising multiple nozzles for ejecting ink onto the print medium defining a total nozzle opening area and in which the filter has a total pore area and a ratio of the total pore area to the total nozzle opening area is such that the nozzles are supplied with adequate ink during operation of the printer system.

7. The ink jet print head of claim 6 in which the ratio of the total pore area to the total nozzle opening area is from about 1 to about 1,000.

8. A filter in combination with an ink jet printer, wherein the ink jet printer comprises a plurality of layers of plates of material laminated together to form a laminated ink jet printer print head including inlets, outlets, and flow channels defined by openings in the plurality of layers of plates, and an ink supply manifold defined by openings in the plurality of layers of plates within the ink jet print head the filter comprising a first layer and a second layer from the plurality of layers of plates of material forming the laminated ink jet print head within the ink supply manifold, each layer including a filtering portion having multiple holes of rectilinear cross-section formed in a rectilinear array, the two filtering portions being juxtaposed to each other with the holes of each filtering portion offset with respect to the holes of the other filtering portion to form an area of overlap of offset holes, the holes having centers such that the centers of adjacent holes are displaced from each other by a fixed distance in each of two mutually perpendicular directions in each filtering portion so that the centers of the offset holes are separated by a displacement distance, thereby forming a filter having an effective filter pore size equal to the overlapping area of the offset holes, the area of overlap being determined by the displacement distance.

9. A filter in combination with an ink jet printer, wherein the ink jet printer comprises a plurality of layers of plates of material laminated together to form a laminated ink jet printer print head including inlets, outlets, and flow channels defined by openings in the plurality of layers of plates, and an ink supply manifold within the ink jet print head defined by openings in the plurality of layers of plates within the ink jet print head the filter comprising a first layer and a second layer from the plurality of layers of material forming the laminated ink jet print head within the ink supply manifold, each layer including a filtering portion having multiple holes, the two filtering portions being juxtaposed to each other with the holes of each filtering portion offset with respect to the holes of the other filtering portion, thereby forming a filter from an overlapping area of offset holes, the holes having centers such that the centers of adjacent holes are displaced from each other by a fixed distance in each of two mutually perpendicular directions having an effective filter pore size smaller than the size of the multiple holes.

10. A method of forming a filter in an ink jet print head, comprising:

laminating a plurality of layers of plates of metallic material together to form a laminated ink jet print head including inlets, outlets, and flow channels defined by openings in the plurality of layers of plates;

forming an ink supply manifold in the ink jet print head defined by openings in the plurality of layers of plates;

providing a first filter layer from the plurality of layers of material within the ink supply manifold, the first filter layer including a first array of holes of rectilinear cross-section formed in a rectilinear army;

providing a second filter layer from the plurality of layers of material within the ink supply manifold, the second filter layer including a second array of holes of rectilinear cross-section formed in a rectilinear army; and juxtaposing the first filter layer and the second filter layer with the holes of the first array and the second array offset from each other so that the holes partly overlap, the holes having centers such that the Centers of adjacent holes are displaced from each other by a fixed distance in each of two mutually perpendicular directions in each of the first filter layer and second filter layer so that the centers of the offset holes are separated by a displacement distance whereby the overlapped holes provide filter pore openings smaller than the holes in the first array and the second array, the area of overlap being determined by the displacement distance.

11. The method of claim 10 in which the step of providing the first filter layer and the second filter layer includes producing the first array and the second array of holes by chemical etching.

12. The method of claim 10 in which the step of providing the first filter layer and the second filter layer includes providing the first filter layer and the Second comprising stainless steel.

13. The method of claim 10 in which the step of providing a first filter layer includes producing the first filter layer and the second filter layer by punching.

14. The method of claim 10 in which the holes of the first array of holes and the holes of the second array of holes have an opening dimension of between about 0.004 to about 0.012 inches.

15. The method of claim 10 in which the holes of the first array of holes and the second array of holes have a rectangular shape.

* * * * *